US005809604A

United States Patent [19]

Olstyn

[11] Patent Number: 5,809,604

[45] Date of Patent: Sep. 22, 1998

[54] TILE GROUT BRUSH

[76] Inventor: Michael Olstyn, 11433 Lakeview Dr., Coral Springs, Fla. 33071

[21] Appl. No.: 812,537

[22] Filed: Mar. 7, 1997

[51] Int. Cl.[6] ..... A47L 13/12; A46B 5/02

[52] U.S. Cl. ..... 15/111; 15/143.1; 15/144.1; 15/145; 15/160; 15/176.2; 15/236.01; D4/118; D4/129

[58] Field of Search ..... 15/111, 143.1, 15/144.1, 144.3, 145, 160, 172, 176.2, 235.3, 236.01; D4/118, 129, 138, 130, 132, 134, 135

[56] References Cited

U.S. PATENT DOCUMENTS

| | | | |
|---|---|---|---|
| 115,040 | 5/1871 | Dunaway | 15/144.1 X |
| D. 282,604 | 2/1986 | Whitaker | D4/118 |
| D. 359,853 | 7/1995 | Haug | D4/129 X |
| 2,290,178 | 7/1942 | Hayford | 15/111 |
| 2,802,229 | 8/1957 | Bangs | 15/160 X |
| 4,610,043 | 9/1986 | Vezjak | 15/111 |
| 5,138,737 | 8/1992 | Thomas | 15/143.1 |
| 5,623,739 | 4/1997 | Thompson | 15/143.1 |

*Primary Examiner*—Mark Spisich
*Attorney, Agent, or Firm*—Robert M. Downey, P.A.

[57] ABSTRACT

A tile grout brush for cleaning grout between tile includes a main body having a generally triangular configuration with an open central zone and including a base portion, a first handle portion and a second handle portion. Bristles are fitted to the base portion and extend from a bottom, outward facing side thereof; the bristles being disposed in bundles arranged in longitudinal rows substantially along a length of the base portion. The first and second handle portions are structured and disposed to promote grasping thereof in order to apply force and reciprocating motion to the bristles against the grout and tile. Threaded sockets are provided on the main body for removable attachment of an elongate extension pole at various selected angled positions relative to the base portion so that the brush can be manipulated to clean areas that are difficult to reach.

5 Claims, 1 Drawing Sheet

TILE GROUT BRUSH

BACKGROUND OF THE INVENTION

1. Field of the Invention

The present invention relates to brush structures and, more specifically, to a tile grout brush having a generally triangular configuration to promote ease of grasping and manipulation of the brush to clean grout between tile.

2. Description of the Related Art

When tile is initially installed on a floor, wall, or ceiling, the grout packed between adjacent tiles is normally bright and clean and thereby enhances the appearance of the tile surface. However, over time, as the tile is exposed to dirt, mildew, food spills and other substances, the grout becomes dirty and/or stained. This diminishes the attractiveness of the tile even if the tile, having an indelible surface, is cleaned to a bright shine. It is, therefore, occasionally necessary to clean grout between tile in order to maintain the desired, brilliant appearance. While there are various chemical products available on the market which are helpful to clean grout, it is almost always necessary to scrub the grout line with a brush having stiff or hard bristles. In many instances, even with the use of chemical cleaning products, it is necessary to apply sufficient force to the bristles against the grout in a rigorous, reciprocating, scrubbing motion. Presently, the only brushes known in the art for scrubbing grout lines, including those specifically marketed as grout brushes, all have a structure which generally resembles a toothbrush. In fact, many people simply use an old toothbrush to clean grout rather than purchasing a grout cleaning brush. Specifically, these toothbrush-type instruments have a brush head and a handle portion extending longitudinally from the brush head in coplanar relation thereto. When scrubbing a grout line using a toothbrush or like instrument, only a small gap remains between the handle and the tile surface. Inevitably, one's hands, fingers, and/or knuckles will rub against the tile surface when scrubbing, causing painful injury. In fact, it is almost impossible to prevent constant rubbing and banging of one's hands on the tile surface when using a toothbrush-type instrument. Furthermore, the orientation of the handle relative to the brush head makes it difficult to exert and maintain force of the bristles against the grout and tile surface being cleaned.

Accordingly, there is an urgent need in the art for an improved tile grout brush which is specifically structured to protect one's hands when grasping the brush during scrubbing and which is further structured to more effectively direct a force from the handle to the bristles to exert a greater force of the bristles against the surface being scrubbed.

SUMMARY OF THE INVENTION

A tile grout brush for cleaning grout between tile includes a main body having a generally triangular configuration with an open central zone and including a base portion, a first handle portion and a second handle portion. Bristles are fitted to the base portion and extend from a bottom, outward facing side thereof; the bristles being disposed in bundles arranged in longitudinal rows substantially along a length of the base portion. The first and second handle portions are structured and disposed to promote grasping thereof in order to apply force and reciprocating motion to the bristles against the grout and tile. Threaded sockets are provided on the main body for removable attachment of an elongate extension pole at various selected angled positions relative to the base portion so that the brush can be manipulated to clean areas that are difficult to reach.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
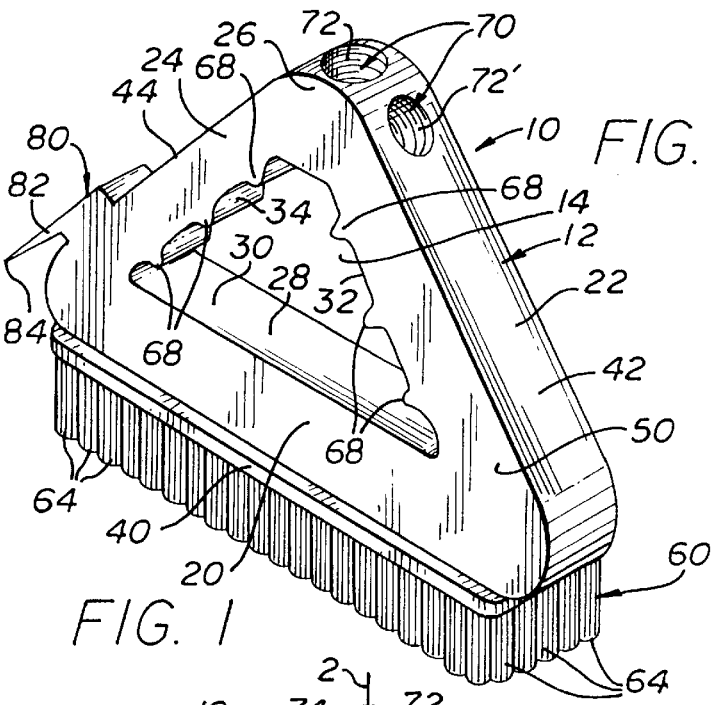
FIG. 1 is a perspective view of the tile grout brush of the present invention.

Referring to the several views of the drawings, the tile grout brush of the present invention is shown and generally indicated as 10. As seen in the several views of the drawings, the tile grout brush 10 includes a main body 12 having a triangular configuration with an open central zone 14. The triangular configuration of the main body 12 is defined by a base portion 20, a first handle portion 22, and a second handle portion 24. The first handle portion 22 and second handle portion 24 extend upwardly and inwardly from opposite ends of the base portion at an angled orientation relative to the base portion 20 and each other, meeting at an apex 26 in spaced relation above a center 28 of the base portion 20.

Figure 7:
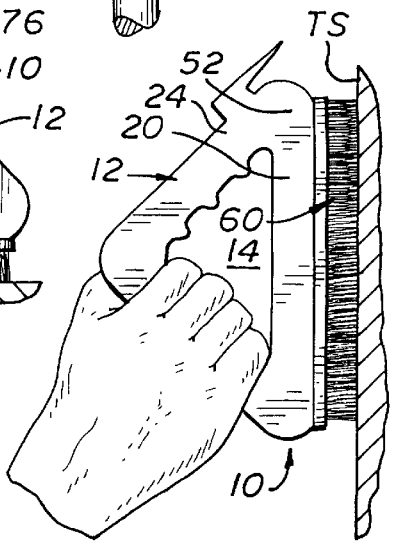
FIG. 7 is a side elevational view illustrating the manner of grasping one of the handle portions of the main body of the brush during use.

The base portion 20, first handle portion 22 and second handle portion 24 each include inward facing surfaces 30, 32, 34, respectively, as well as outward facing sides 40, 42, and 44, respectively. The main body 12, comprised of the base portion and first and second handle portions 22, 24 may also include opposite side faces 50, 52. Notwithstanding, the first and second handle portions are structured and configured to accommodate grasping of a hand so that the fingers are wrapped about the respective first or second handle portion 22, 24, as best seen in FIG. 7.

A plurality of brush bristles 60 are provided on the base portion 20. The bristles 60 are fitted to the outward facing side 40 of the base portion 20 so that they extend outwardly therefrom, in generally perpendicular relation to the outward facing side 40, terminating at free distal ends along a common plane 62. The bristles 60 may have their proximal end zones (opposite the free distal ends) embedded within the material of the base portion 20 or within cavities provided through the outward facing side 40 being held therein with epoxy or other suitable adhesive means. Alternatively, the bristles may be fitted to a plate in a manner such as that described above, wherein the plate is fixed to the outward facing side of the base by suitable means well known in the art.

The bristles 60 may be made of nylon, plastic or other synthetic material. Alternatively, the bristles may be of a natural fiber. It is, however, preferred that the bristles be of a stiff, rigid nature so that they do not easily bend and/or collapse when their distal ends are forced against a tile surface TS (as seen in FIGS. 4–7) and moved in a reciprocating motion.

As best seen in FIG. 1, the bristles 60 are preferably grouped in bundles 64, wherein each bundle 64 includes a plurality of individual bristles disposed in a generally circular package to define a cylindrical configuration. The bristle bundles 64 are positioned and arranged in a plurality of longitudinal rows along the outward facing side 40 of the base portion 20.

Figure 3:
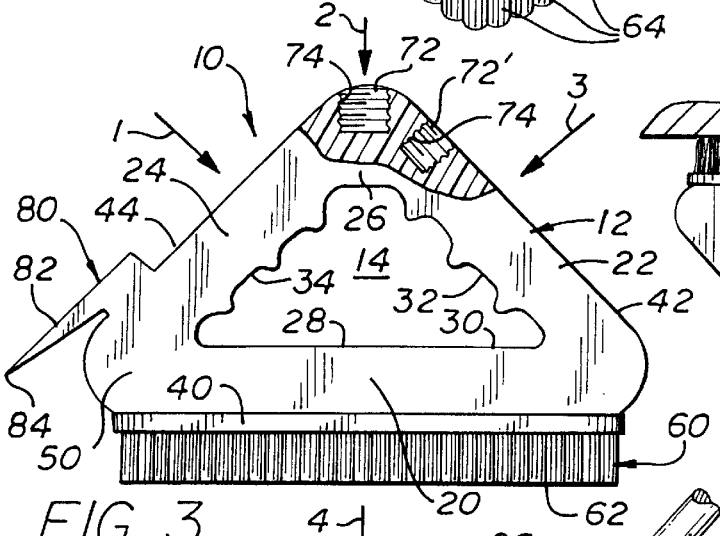
FIG. 3 is a side elevational view of the tile grout brush, shown in partial section to illustrate extension handle attachment means including a plurality of threaded sockets provided in the main body of the brush.
Figure 4:
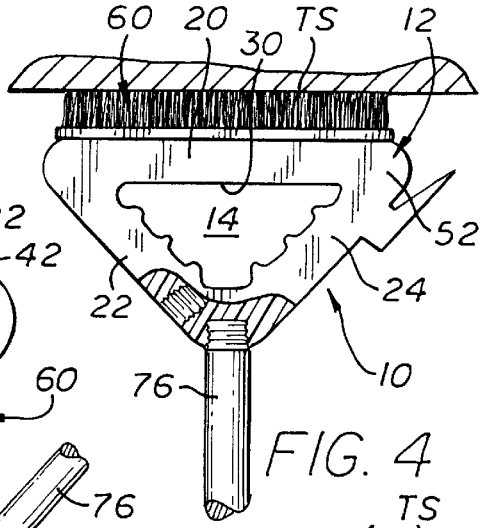
FIG. 4 is an inverted side elevational view of the tile grout brush, in partial section, showing an extension pole attached to the main body of the brush at one of the threaded sockets in accordance with a first preferred angle of attachment, wherein the tile grout brush is shown cleaning grout on an overhead tile surface.
Figure 5:
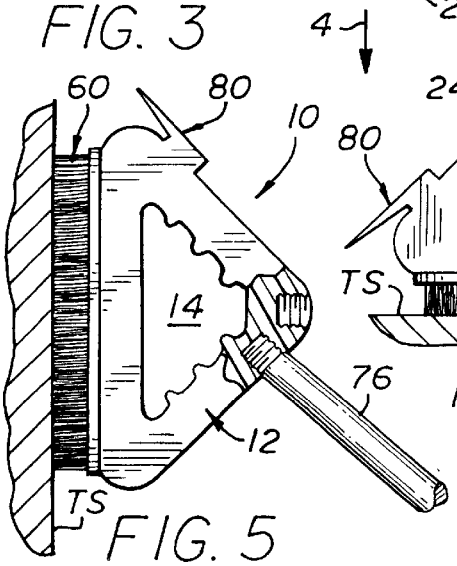
FIG. 5 is a side elevational view, in partial section, illustrating the extension pole attached to a different threaded socket in accordance with a second preferred attachment angle of the pole to the tile grout brush, wherein the brush is shown cleaning grout on a vertical tile surface.
Figure 6:
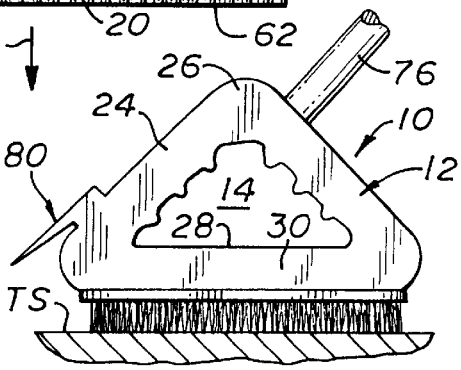
FIG. 6 is a side elevational view of the tile grout brush with the extension pole attached thereto, wherein the tile grout brush is shown cleaning grout on a floor surface.

The angled orientation of the first and second handle portions 22, 24 relative to the base portion 20 serves to direct a downward force from the handle portions 22, 24 to the base portion 20 and distal plane 62 of the bristles 60. Specifically, a force applied in the direction of arrows 1, 2 or 3 on the first and/or second handle portions 22, 24 produces a resultant force in the direction of arrow 4, as seen in FIG. 3. This permits effective use of the brush 10 to apply a sufficient scrubbing force when the brush is held by grasping, or using a pole extension, at various angles, as seen throughout FIGS. 4–6. Further, the structure, arrangement and configuration of the first and second handle portions 22, 24 provides a comfortable grip serves to protect the fingers, knuckles and hand of the user when grasping the brush and scrubbing, as illustrated in FIG. 4. Specifically, when grasping the first or second handle portions 22, 24, the knuckles on the fingers remain protected within the central zone 14, thus preventing accidental contact with the tile surface TS or other objects when scrubbing, and thereby preventing injury to the hands.

The inward facing surfaces 32, 34 of the handle portions 22, 24 may be provided with a series of protruding bumps 68 arranged in spaced relation to accommodate placement of the user's fingers therebetween, thereby providing a more secure, comfortable grip.

Figure 2:
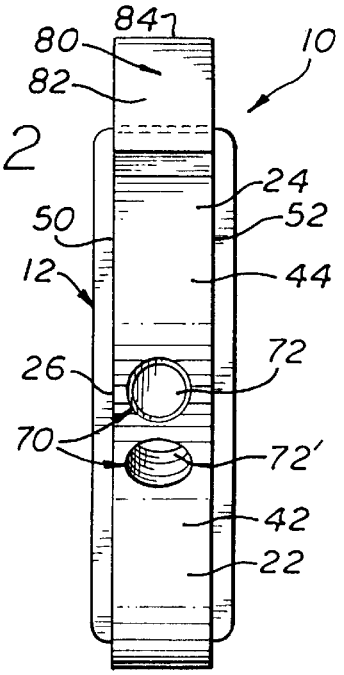
FIG. 2 is a top plan view of the tile grout brush of FIG. 1.

To facilitate use of the tile grout brush 10 to clean grout along difficult to reach areas, the main body 12 is provided with extension handle attachment means 70 including a plurality of sockets 72, 72' having interior thread means 74 for threaded engagement with corresponding threads on the end of an extension pole 76. The various sockets 72, 72' extending into the main body 12 at various angled orientations relative to the base portion 20, facilitate attachment of the extension pole 76 at various select angled orientations to permit an effective scrubbing force and motion as needed when reaching to ceiling surfaces, as shown in FIG. 2, wall surfaces (see FIG. 5), and floor surfaces (see FIG. 6).

Scraper means 80 are provided on the main body 12 for scraping excess grout, residue and other substances from the tile surface TS when cleaning the grout and tile of the tile surface TS. The scraper means 80 includes a scraper blade 82 integrally formed on either of the handle portions 22, 24 and extending downwardly therefrom away from the apex 26, terminating at a relatively sharp edge 84.

In a preferred embodiment, the entire main body 12, including the base portion 20, handle portions 22, 24 and scraper means 80, is formed of a plastic material by injection molding, vacuum form molding or extrusion molding in accordance with conventionally known methods.

While the instant invention has been shown and described in what is considered to be a preferred and practical embodiment thereof, it is recognized that departures may be made within the spirit and scope of the present invention which, therefore, should not be limited except as defined in the following claims under the doctrine of equivalents.

Now that the invention has been described,

What is claimed is:

1. A tile grout brush for cleaning grout between tile comprising:

a main body having a generally triangular configuration with an open central zone including a base portion, a first handle portion and a second handle portion, said base portion and said first and second handle portions each including an inward facing surface and an outward facing side, said main body further including extension handle attachment means thereon for removable attachment of an elongate pole thereto, a plurality of brush bristles fitted to and extending from said base portion on said outward facing side, and said first and second handle portions including grip means for grasping with a hand and including a plurality of protruding bumps on said inward facing surface of said first and second handle portions, said bumps being positioned and arranged to accommodate individual fingers therebetween, said first and second handle portions being structured and disposed for applying force and motion to said bristles against the grout and tile.

2. A tile grout brush as recited in claim 1 wherein said extension handle attachment means includes at least one socket on said main body and having thread means therein for threaded engagement with corresponding threads on said elongate pole.

3. A tile grout brush as recited in claim 1 wherein said brush bristles are disposed in a plurality of bristle bundles, said bristle bundles being positioned and arranged in a plurality of longitudinal rows along said outward facing side of said base portion.

4. A tile grout brush as recited in claim 2 including a plurality of said sockets on said main body for removable attachment of said pole to said main body at a plurality of selected angular adjusted positions relative to said base portion.

5. A tile grout brush as recited in claim 1 further including scraper means on said main body for scraping engagement with the tile to remove excess grout, residue and other unwanted substances therefrom.

* * * * *